United States Patent [19]

Leonard

[11] Patent Number: 4,466,999

[45] Date of Patent: Aug. 21, 1984

[54] ATMOSPHERIC GAS PRACTICE FOR HOT-DIP COATING OF METALS

[75] Inventor: Ralph W. Leonard, Pittsburgh, Pa.

[73] Assignee: United States Steel Corporation, Pittsburgh, Pa.

[21] Appl. No.: 546,236

[22] Filed: Oct. 28, 1983

[51] Int. Cl.[3] ..... B05D 1/18

[52] U.S. Cl. ..... 427/329; 427/432; 427/433

[58] Field of Search ..... 427/433, 431, 432, 320, 427/321, 329

[56] References Cited

U.S. PATENT DOCUMENTS 4,053,663 10/1977 Caldwell ..... 422/432

4,148,946 4/1979 Byrd ..... 427/321

FOREIGN PATENT DOCUMENTS 2048959 12/1980 United Kingdom ..... 427/432

*Primary Examiner*—Sam Silverberg

*Attorney, Agent, or Firm*—Arthur J. Greif

[57] ABSTRACT

In the hot-dip coating utilizing molten metals in which the partial pressure of the metal vapor is substantial at the coating temperature, the resultant metal vapor in the snout area over the metal bath tends to cause pin-hole type imperfections on the resultant coating. For example, substantial vaporization occurs during high temperature galvanizing and during hot-dip coating of Al-Zn, in which Al is a major constituent, such that the bath must be maintained at a high enough temperature to keep the aluminum molten. The accumulation of such vapors inside the snout area is minimized by (i) utilizing baffles within the snout to isolate it as much as possible from the cooling section of the annealing furnace, and (ii) venting a portion of the gas from the snout.

8 Claims, 1 Drawing Figure

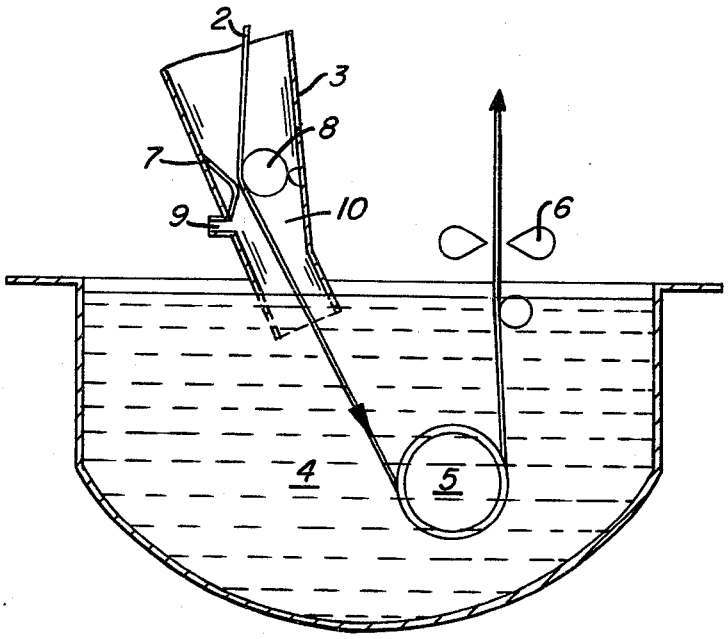
2
3
8
7
9
10
6
4
5

ATMOSPHERIC GAS PRACTICE FOR HOT-DIP COATING OF METALS

This invention relates to the hot-dip coating of metal strands such as sheet and strip, and is more particularly related to a procedure for minimizing bare spots caused by the vaporization of metal from the coating bath.

In the hot-dip coating of metal strands, such as ferrous metal strands, the strand is first cleaned either electrolytically or by passing through an oxidizing furnace to burn off surface oils. Whichever of such cleaning methods is employed, the strand will generally be passed through an annealing furnace which contains a reducing gas atmosphere to reduce the surface oxides. Thereafter, the strand is passed to a cooling section having a controlled atmosphere to prevent re-oxidation of the strand—the downstream end of such section or snout being partially submerged in the coating bath. The metal vapors evaporating from the bath surface within the snout either directly condense on the internal portions of the snout (including the bath surface) and the strand itself, or will first be oxidized and thereafter be so deposited. Such condensation and deposition of these contaminents ("Zinc dust") necessitates frequent cleaning of the snout area and maintenance or repair of the upstream heater elements. Additionally, the presence of these contaminants on the strand itself and those that accumulate on the bath surface and contact the strip surfaces as it enters the coating bath prevent complete wetting between the strand surface and the molten metal bath during the short time that the strand is immersed in the bath—resulting in small bare spots or pinholes which are formed when the thin coating solidifies after exiting the coating bath.

The problems, associated with metal vapors, occur in hot-dip coating procedures in which the partial pressure of the coating-metal vapor in the atmosphere inside the snout is substantial. These problems can occur in hot-dip coating operations using essentially pure zinc baths. However, since the partial pressure (i.e. the rate of vaporization) is highly dependent on temperature, the accumulation of zinc dust will occur at a much higher rate inside the snout of, for example, (i) a bath containing major amounts of both zinc and aluminum (in which the bath temperature may be 1100° F. or higher) or (ii) the newly proposed galvanizing baths (i.e., baths containing >80% Zn), operated at temperatures in excess of 950° F., than with a conventional galvanizing bath maintained at a temperature of 850°-925° F. Thus, the occurrence of bare spots attributable to zinc dust is even greater for the latter coating baths than for conventional galvanizing baths. One method for decreasing the occurrence of pinholes and bare spots is shown in U.S. Pat. No. 4,053,663, in which preheated atmospheric gases are swept across the bath surface. As taught in British Patent Application GB No. 2,082,206A (the disclosure of which is incorporated herein by reference), while the procedure of the U.S. Pat. No. 4,053,663 has been effective in reducing the occurrence of pinholing, it has not been substantially eliminated, and has nevertheless resulted in frequent maintenance and repair resulting from the upstream deposition of the harmful deposits. The method of the British patent application is based on an entirely different procedure. Rather than using gases which are swept across the bath surface, the latter method maintains the atmospheric conditions within the snout as quiescent as possible so as to maintain high concentrations of zinc vapor above the bath, thereby preventing further evaporation. As an adjunct, this method interposes baffles within the snout area to decrease the cross-sectional area thereof, whereby the amount of reducing gas introduced at a point upstream of the snout will be at a controlled low rate and just sufficient to take care of gas loss due to leakage. The resultant slow diffusion of the reducing gas from the upstream portion to the downstream end achieves the desired minimization of turbulence. It was found, however, that while this latter method further decreased the occurrence of pinholes and bare spots and the need for maintenance of internal sections of the snout, that such problems (associated with deposition of metal vapors) nevertheless occurred, i.e. by condensation of zinc vapors on the colder metal surfaces of both the snout and the strand in the vicinity of the quiescent vapor cloud. These problems have now been substantially overcome, wherein the latter procedure is modified by creating a controlled, substantial flow of atmosphere gas from the higher pressure cooling section through the baffled area into the lower pressure snout area and thereafter venting these gases outside of the snout area, such that virtually all the zinc dust is entrained with the vented atmospheric gases and removed from the snout before it has an opportunity to deposit on the snout or strand surfaces.

The operation and advantages of the instant invention will better be appreciated by reference to the following detailed description, together with the appended claims and the drawing in which:

The FIGURE is a sectional view illustrating a molten coating bath, the lower portion of the snout area associated therewith, and the instant venting system.

Referring to the FIGURE, strand 2 exits from the furnace section (not shown), proceeds downwardly into protective enclosure hood (snout) 3 and from there into the molten coating bath 4 around sink roll 5, and into a coating thickness control zone in which excess molten metal is removed, such as by air knife 6. As shown in British Patent Application No. 2,082,206A, the flow rate of protective gas, injected at an upstream point is diminished by employing baffle systems such as walls 7 and/or seal rollers 8. In departure from the teachings of the British patent application, vent 9 is incorporated into the walls of the snout 3 at a point downstream of the baffles, but above the bath surface. As a result, a portion of the atmosphere within the space 10, circumscribed by the baffles, the walls of the snout, and the top surface of the bath, is continuously vented.

The British patent teaches that the protective gas injected upstream of the baffles should be just above atmospheric pressure so as to permit this gas to diffuse through the baffle system and make up for the very slight gas losses which may occur, but so as to maintain the environment within 10 "substantially quiescent". On two separate occasions, each amounting to an operating period of approximately 24 hours, vent 9 was blocked—approximating the system shown in the British Patent. During such blockage, it was found that gas flow rates of the order of 10 ft.$^3$/hr. were sufficient to function for the abovesaid make-up purposes. By contrast, the venting procedure of the instant invention requires that the gas flow rate be more than an order of magnitude greater, i.e. at least 300 ft.$^3$/hr. It is desirable that the size of the vent be small and the gas flow rate be sufficient to prevent back-diffusion of oxygen from the outside air, that might otherwise oxidize the strip. For this reason, it is desirable to attach a pipe (such as shown by 9) to the opening in the snout wall, to increase the oxygen diffusion distance and thereby reduce the rate of oxygen infiltration. The flow-rate of the protective gas injected at the upstream point can be within the range of 300 to 3000 ft.$^3$/hr., and generally will be within the range 500 to 2500 ft.$^3$/hr., with a range of 1000 to 2000 being most preferred. The lower end of the range is a function of the minimum required to achieve the desired venting action, while the upper end is dictated by economics of gas utilization. The composition of the protective gas will, of course, depend upon both the compositions of the metal strand and of the molten coating metal. In the hot-dip coating of ferrous metal strands with coating baths which are primarily zinc, primarily aluminum, or combinations thereof, i.e. in which zinc is present in a range of 5 to 95% (examples of such baths are the 30 to 75% Zn baths shown in U.S. Pat. No. 3,343,930 and the 12 to 24% Zn baths shown in Japanese Laid-Open Specification No. 58-144462), a desirable protective gas will be a dry reducing gas consisting essentially of 10 to 80% hydrogen, balance nitrogen. In such instances, where the hydrogen concentration in the vented atmospheric gas is sufficiently high, the exiting gases can be burned if desired; while, if necessary, the zinc dust so vented can be removed by standard filtration methods.

I claim:

1. In the hot-dip coating of ferrous metal strand wherein the strand is passed through a bath of molten metal in which the partial pressure of the metal vapor above the bath is substantial at the temperature at which coating is effected, the strand is passed through a hood enclosure, the downstream end of which is below the surface of the bath, a protective gas is introduced into said enclosure at an upstream point thereof, said enclosure having internal baffles at a point between said upstream point of protective gas introduction and said downstream end so as to substantially limit the internal cross-sectional area of said enclosure and thereby restrict the amount of protective gas required to be introduced therein, the improvement for decreasing the amount of such metal vapors depositing on the strand surfaces and the internal parts of the enclosure which comprises, at a point downstream of said baffles but above the bath surface, venting the atmosphere within said enclosure and controlling the rate of introduction of said protective gas and the cross-sectional opening of the vent system so as to vent said atmosphere within said enclosure at a rate of from 300 to 3000 ft.$^3$/hr.

2. The method of claim 1, wherein the major constituents of said bath are selected from aluminum and zinc, and combinations thereof.

3. The method of claim 2, wherein said bath consists essentially of 12 to 24% zinc, up to 4% silicon, 0.3 to 3.5% iron, and the balance aluminum.

4. The method of claim 3, wherein said protective gas consists essentially of 10 to 80% hydrogen, balance nitrogen, and is introduced and vented at a rate of 500 to 2500 ft.$^3$/hr.

5. The method of claim 4, wherein said baffles are constructed to isolate the vented portion of the enclosure from the upstream portion so as to prevent the ingress of bath vapors into said upstream portion.

6. The method of claim 5, wherein said atmosphere vent rate is 1000 to 2000 ft.$^3$/hr.

7. The method of claim 2, wherein said bath contains more than 80% Zn and is maintained at a temperature in excess of 950° F.

8. The method of claim 7, wherein said atmosphere vent rate is 500 to 2500 ft.$^3$/hr.

* * * * *